US008360761B2

(12) United States Patent
Silva et al.

(10) Patent No.: US 8,360,761 B2
(45) Date of Patent: Jan. 29, 2013

(54) FIXATION ARRANGEMENT FOR AN OIL PUMP IN A REFRIGERATION COMPRESSOR

(75) Inventors: Fabiano Domingos Silva, Joinville (BR); Luis Fabiano Jovita, Joinville (BR); Fernando Antonio Ribas, Jr., Joinville (BR); Andrea Lopes, Joinville (BR); Fabio Henrique Klein, Joinville (BR); Emilio Rodrigues Hülse, Joinville (BR)

(73) Assignee: Whirlpool S.A., São Paulo-SP (BR)

( * ) Notice: Subject to any disclaimer, the term of this patent is extended or adjusted under 35 U.S.C. 154(b) by 413 days.

(21) Appl. No.: 12/740,133

(22) PCT Filed: Oct. 29, 2008

(86) PCT No.: PCT/BR2008/000325

§ 371 (c)(1),
(2), (4) Date: May 26, 2010

(87) PCT Pub. No.: WO2009/055889

PCT Pub. Date: May 7, 2009

(65) Prior Publication Data

US 2010/0233003 A1 Sep. 16, 2010

(30) Foreign Application Priority Data

Oct. 31, 2007 (BR) ..... 0705336

(51) Int. Cl.
*F01C 21/04* (2006.01)

(52) U.S. Cl. ..... 418/83; 417/410.3

(58) Field of Classification Search ..... 418/83; 417/410.3, 372, 423.13
See application file for complete search history.

(56) References Cited

U.S. PATENT DOCUMENTS 6,450,785 B1 9/2002 Dellby et al.
6,716,001 B2 * 4/2004 Kim ..... 417/363

FOREIGN PATENT DOCUMENTS

WO WO-9322557 A1 11/1993
WO WO-0001949 A1 1/2000
WO WO-2008052297 A1 5/2008

* cited by examiner

*Primary Examiner* — Zelalem Eshete
(74) *Attorney, Agent, or Firm* — Gifford, Krass, Sprinkle, Anderson & Citkowski, P.C.

(57) ABSTRACT

The fixation arrangement of the present invention is applied to a compressor of the type which comprises a shell (1) inferiorly defining an oil sump (3) and housing: a crankshaft (4) journalled in a cylinder block (2) and carrying a rotor (6) formed by a stack of annular laminations; and an oil pump (10) comprising a tubular sleeve (20), which is superiorly mounted to the rotor (6) and inferiorly immersed in the oil sump (3), and a pump shaft (30). The fixation arrangement comprises at least one retention element (40) radially and axially locked around the tubular sleeve (20) and having a radially outer locking portion (41), which is seated and radially forced against a respective confronting circumferential extension (6*c*) defined between two consecutive annular laminations, in order to axially lock the tubular sleeve (20) to the rotor (6).

16 Claims, 8 Drawing Sheets

FIXATION ARRANGEMENT FOR AN OIL PUMP IN A REFRIGERATION COMPRESSOR

FIELD OF THE INVENTION

The present invention refers to a fixation arrangement for an oil pump in a refrigeration compressor of the type which comprises, in the interior of a generally hermetic shell inferiorly defining an oil sump and carrying: a cylinder block in which is journalled a crankshaft, for driving a refrigerant gas pumping mechanism of the compressor, and carrying an electric motor rotor, formed by a stack of annular laminations and further carrying, inferiorly, an oil pump which comprises a tubular sleeve, superiorly mounted to the rotor and inferiorly immersed in the oil sump, and a stationary pump shaft, internal to the tubular sleeve, defining an annular gap with the inner wall of the latter and having a lower end supported by one of the parts of shell and cylinder block. In a more specific form, the present invention refers to a fixation arrangement of the oil pump to the rotor.

BACKGROUND OF THE INVENTION

An important factor for the correct operation of the majority of the refrigeration compressors is the adequate lubrication of the components that have a relative movement in relation to each other. The lubrication is obtained by pumping lubricant oil provided in an oil sump which is defined in the interior of a lower portion of a generally hermetic shell. This oil is pumped until it reaches the compressor parts presenting relative movement, wherefrom said oil returns, for example, by gravity, to the oil sump.

In some known constructions, the compressor comprises a generally vertical crankshaft carrying a lubricant oil pump, which conducts said oil to the compressor parts to be lubricated, using the rotation of said crankshaft. In these constructions, the oil is pumped from the oil sump by spinning and mechanical dragging.

Technology has been increasingly improving the performance of the refrigeration compressors, and one of the forms to obtain such improvements is through the modulation of the refrigeration capacity of the compressor, upon operation thereof in the refrigeration system to which it is coupled, which permits to reduce the operating rotation of said compressor, when the thermal load is reduced. This procedure is carried out with variable speed compressors (VCC), which permit obtaining considerable performance gains of the refrigeration system. Nevertheless, for the good operation of the compressor at low rotations, further improvements in some constructive aspects of the compressor are still required. One of these constructive aspects refers to the pumping of oil for lubricating the components with relative movement, particularly the bearings. The most employed concept for oil pumping in compressors is based on the centrifugal effect to carry out the pumping. The centrifugal effect uses the pump rotation speed to generate a centrifugal force in the oil. In low rotation operations, this centrifugal effect is impaired, it being necessary to develop other pumping principles in order to comply with the lubrication demand.

There are known some prior art solutions for oil pumping in variable speed compressors. In these constructions (WO93/22557, U.S. Pat. No. 6,450,785), the crankshaft inferiorly carries a pump shaft provided with superficial channels and which is internally disposed in a tubular sleeve, one of the parts of pump shaft and tubular sleeve being rotatively stationary in relation to the other part, so as to provide the dragging effect on the oil being suctioned by centrifugal force caused by rotation of the motor.

The solution disclosed in WO93/22557 presents the pump shaft externally provided with helical grooves and affixed to the crankshaft, in order to rotate therewith, the tubular sleeve being attached to the electric motor stator, by a fixation rod, said tubular sleeve being mounted around the pump shaft with a radial gap.

The solution disclosed in U.S. Pat. No. 6,450,785 presents the pump shaft externally provided with helical grooves on its outer surface and inferiorly attached to the electric motor stator, in order to remain stationary, while the tubular sleeve rotates together with the shaft and the rotor of the electric motor.

The solution object of Brazilian Patent Application PI0604908-7 presents an oil pump in which the tubular sleeve is provided with helical grooves on its inner surface and affixed to the rotor-crankshaft assembly, the pump shaft being attached to one of the parts of stator and shell.

This oil pump construction results in a higher pumping efficiency, allowing an efficient pumping mainly at low rotations. The pumping principle of this construction permits the compressors to operate with capacity modulation at extremely low rotations.

For a better pumping of oil from the oil sump, it is desirable that the oil elevation channel, defined by the helical groove in the tubular sleeve of the oil pump, is made with the greatest possible diameter, said helical groove being provided internally to the tubular sleeve, which rotates so that the oil pumped from the oil sump, by centrifugal force, is pushed to the bottom of the helical groove and dragged upwards. Since the tubular sleeve of the oil pump rotates with full compression of the centrifugal force, the oil ascends through the helical groove without escaping therefrom, as the centrifugal force pushes the oil to the bottom of the channel and the side walls of said helical groove do not allow the oil to descend gravitationally. This oil seated on the lower part of the helical development of the helical groove is progressively ascendingly dragged. It is always desirable to have the channel provided on the inner surface of the tubular sleeve. However, the machining of the helical groove in a tubular sleeve made of metallic material is extremely difficult, expensive and complex. Thus, it is desirable that the tubular sleeve is made in plastic material, already containing the inner helical groove.

Nevertheless, affixing the tubular sleeve made of plastic material directly in the interior of a lower tubular portion of the crankshaft or of an axial hole of the rotor presents a serious inconvenience, resulting from the fact that the plastic material has its dimensional characteristics altered with time, mainly when submitted to the operational temperature conditions in the interior of the compressor shell. The fixations which use mechanical interference by friction or by threading do not guarantee a reliable, strong and correct retention of the plastic tubular sleeve during the desired useful life of the compressor, allowing the occurrence of misalignments, faster wear of the involved pieces and insufficient oil pumping to promote the degree of lubrication required by the compressor project.

OBJECTS OF THE INVENTION

It is an object of the present invention to provide a fixation arrangement for an oil pump in a refrigeration compressor which allows and guarantees, for the whole operating life of the compressor, an adequate and secure fixation of the oil pump to one of the parts of crankshaft and rotor.

A specific object of the present invention is to provide an arrangement, such as cited above and which guarantees the desired fixation of the oil pump to the crankshaft or to the rotor of the compressor, in the cases in which the oil pump is provided in a material different from that used for forming the part to which said oil pump will be affixed, particularly when the oil pump is provided in plastic material or the like.

Another object of the present invention is to provide an arrangement, such as cited above and which further allows obtaining a correct relative axial positioning between the oil pump and the crankshaft and maintaining this positioning along the whole operating life of the compressor.

A further object of the present invention is to provide an arrangement, such as cited above, which does not require high constructive precision of the parts to be affixed, and which is easy to construct and mount with a low cost.

These and other objects of the present invention are achieved through the provision of a fixation arrangement for an oil pump in a compressor of the type which comprises a shell inferiorly defining an oil sump and carrying: a cylinder block in which is journalled a crankshaft having a lower portion projecting downwards from the cylinder block; an electric motor rotor formed by a stack of annular laminations defining an axial central hole having an upper hole portion, inside which is fitted and affixed the lower portion of the crankshaft, and a lower hole portion; an oil pump comprising a tubular sleeve, superiorly mounted to the rotor and inferiorly immersed in the oil sump, and a stationary pump shaft, internal to the tubular sleeve, defining an annular gap with the inner wall of the latter and having a lower end supported by one of the parts of the shell and cylinder block.

The fixation arrangement of the present invention comprises at least one retention element disposed around the tubular sleeve and radially and axially locked thereto, the retention element having a radially outer locking portion, which is seated and radially forced against a respective and confronting circumferential extension defined between two consecutive annular laminations, so as to axially lock the tubular sleeve to the rotor.

According to a way of carrying out the present invention, the fixation arrangement comprises a plurality of retention elements disposed around the tubular sleeve, each retention element having its locking portion seated on a respective circumferential extension of the inner wall of the lower hole portion of the rotor.

According to another way of carrying out the present invention, the plurality of retention elements comprises at least two retention elements axially aligned and spaced from each other and at least one retention element which is diametrically opposite and axially equally spaced in relation to the first two ones.

In a particular aspect of the present invention, each retention element comprises an open ring, having a circumferential extension between about 120° and about 270° and presenting an outer diameter slightly superior to the inner diameter of the lower hole portion of the rotor, the tubular sleeve being provided with at least one outer circumferential channel, in whose interior is housed and axially locked at least one retention element mounted around the tubular sleeve, so that at least part of the locking portion of each retention element can deflect in a direction opposite to that of the mounting displacement of the tubular sleeve in the interior of the rotor.

BRIEF DESCRIPTION OF THE DRAWINGS

The invention will be described below, with reference to the enclosed drawings, given by way of example of an embodiment of the invention and in which.

DESCRIPTION OF THE ILLUSTRATED EMBODIMENT

Figure 1:
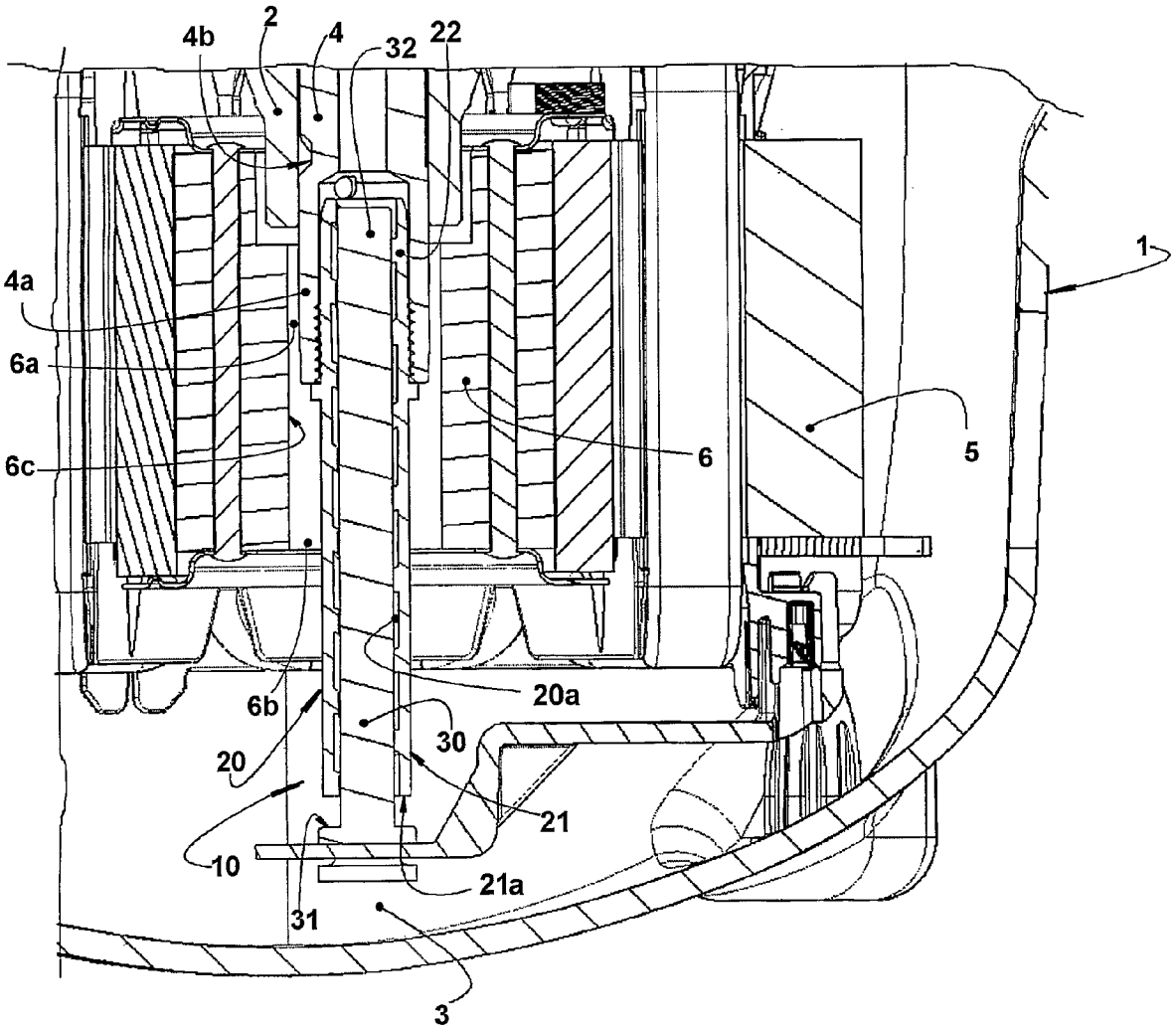
FIG. 1 PRIOR ART
FIG. 1 schematically represents an enlarged longitudinal sectional view of a refrigeration compressor presenting a vertical crankshaft which inferiorly carries an oil pump, constructed according to Brazilian Patent Application PI0604908-7, and which is partially immersed in the oil of an oil sump defined in a lower portion of the shell of said compressor.

The present invention will be described for a reciprocating hermetic compressor (for example of the type applied to a refrigeration system) presenting a generally hermetic shell 1 carrying a cylinder block 2 which defines a cylinder within which actuates a reciprocating piston (not illustrated). In an inner lower portion of the shell 1 is defined an oil sump 3, wherefrom the lubricant oil is pumped, by an oil pump 10, to the compressor movable parts.

In the construction described herein, the refrigeration compressor is of the type which is driven by a crankshaft 4 which moves the piston, said crankshaft 4 superiorly presenting an eccentric portion (not illustrated) and being medianly journalled to the cylinder block 2 and having a lower portion projecting downwards from the cylinder block 2 and carrying the oil pump 10.

The cylinder block 2 secures a stator 5 of an electric motor, further including a rotor 6 attached to the crankshaft 4, so as to rotate the latter upon operation of the motor, said rotor 6 being formed by a stack of annular laminations presenting an axial central hole 6*a* having an upper hole portion, in the interior of which is fitted and affixed a lower portion 4*a* of the crankshaft 4, and a lower hole portion 6*b*, presenting an inner wall which defines circumferential extensions 6*c* between each two consecutive annular laminations of the lamination stack that forms the rotor 6.

The oil pump 10 comprises a tubular sleeve 20 having an upper portion 21 mounted to the rotor 6 and a lower portion 22 immersed in the oil sump 3, and an elongated stationary pump shaft 30 internal to the tubular sleeve 20, defining an annular gap in relation to an adjacent confronting inner surface of the tubular sleeve 20 and having a mounting lower end 31 supported by one of the parts of the shell 1 and cylinder block 2, as already described in Brazilian Patent Application PI0604908-7. In this previous construction, the tubular sleeve 20 is affixed, by threading, to the cylindrical tubular lower portion 4*a* of the crankshaft 4 (FIG. 1).

The pump shaft 30, which is stationary in this construction, presents its mounting lower end 31 projecting beyond a lower end 21*a* of the lower portion 21 of the tubular sleeve 20, to be affixed to at least one of the parts of shell 1, cylinder block 2 and stator 5, said fixation being carried out by appropriate means, such as described in the co-pending Brazilian Patent Application PI0604908-7 or also through fingers, glue, screw, rivet, clamps, snap-on, welding, etc., this fixation not being object of the present invention.

In the solution of the present invention, the tubular sleeve 20 is affixed to the rotor 6, so as to rotate therewith, and presents a lower portion immersed in the lubricant oil contained in the oil sump 3, and an upper portion which is in fluid communication with an helical outer oil channel 4*b*, provided in the crankshaft 4 and which conducts the oil pumped by the oil pump 10 to the compressor parts to be lubricated.

The tubular sleeve 20 is driven in rotative movement upon rotation of the rotor 6, said movement being provoked by operation of the electric motor, whilst the pump shaft 30 remains rotatively fixed. The relative rotating movement between the tubular sleeve 20 and the pump shaft 30 provokes an ascending movement of the oil from the oil sump 3, by mechanical dragging and centrifugal force. The ascending movement of the oil is carried out through channels provided in the form of helical grooves 20*a* on the inner surface of the tubular sleeve 20, which extend from the end portion thereof immersed in the lubricant oil of the oil sump 3, so as to pump this oil to the relatively moving parts of the compressor to be lubricated.

The helical grooves 20*a* define, with an adjacent confronting outer surface portion of the pump shaft 30, lubricant oil ascending channels, which convey oil from the oil sump 3, pumped by the oil pump described herein, to the parts with relative movement of the compressor. The pump shaft 30 is disposed in the interior of the tubular sleeve 20, so as to be freely displaced in the interior of the latter, in radial directions orthogonal to the crankshaft 4 and rotatively fixed in relation to the rotor 6.

In a way of carrying out the present invention, at least the tubular sleeve 20, which is in permanent contact with said crankshaft 4, is molded in plastic material. This particular construction presents the advantages mentioned above. In a particular constructive form, the tubular sleeve 20 and the pump shaft 30 are provided, for example, in plastic material.

The construction of the parts of tubular sleeve 20 and pump shaft 30 in plastic material facilitates the manufacture of these components, particularly facilitating the formation of the helical grooves 20*a* on the inner surface of the tubular sleeve 20. Moreover, the manufacture in plastic material also minimizes heat transfer from the crankshaft 4 to the oil being pumped, due to the low thermal conductivity of said material.

The present invention provides a fixation arrangement of an oil pump 10 in a compressor of the type aforedescribed, said arrangement comprising at least one retention element 40 disposed around the tubular sleeve 20 and which is radially and axially locked thereto. The retention element 40 has a radially outer locking portion 41, which is seated and radially forced against a respective confronting circumferential extension 6*c* defined between two consecutive annular laminations of the lamination stack of the rotor 6, so as to axially lock the tubular sleeve 20 to the rotor 6.

According to a way of carrying out the present invention, illustrated in the enclosed drawings, the tubular sleeve 20 carries a plurality of retention elements 40 disposed in at least one plane transversal to the axis of the tubular sleeve 20, as described ahead.

The retention element(s) 40 is (are) obtained in a different material from that of the tubular sleeve 20 and more resistant to deformations when submitted to ambient conditions, such as temperature, existing in the interior of the shell 1, in order to guarantee the fixation of the oil pump 10 to the rotor 6 to be maintained unaltered during the whole operating life of the compressor. In a way of carrying out the present invention, the retention element 40 is metallic.

However, it should be understood that, although not illustrated, the fixation arrangement of the present solution can present only one retention element 40, for example in the form of a preferably metallic annular disc, which is carried by the tubular sleeve 20 or mounted to the rotor 6 before the introduction of the tubular sleeve 20 in the latter, or also only two retention elements 40 disposed diametrically opposite to one another, in a single piece or in separate pieces.

The number of retention elements 40 is defined not only due to their fixation action to the rotor 6, but also due to the constructive characteristics of the tubular sleeve 20. In the constructions in which the tubular sleeve 20 does not have its upper portion telescopically fitted and guided in the interior of a tubular lower portion 4*a* of the crankshaft 4, the retention elements further present the functions of centralizing and axially aligning the tubular sleeve 20 in relation to the crankshaft 4. In these cases, the fixation arrangement of the present invention must present at least three retention elements 40, angularly spaced from each other, for example, such as illustrated, having two retention elements 40 axially aligned and spaced apart and another retention element 40 being disposed diametrically opposite and axially equally spaced in relation to the two first ones. In this way of carrying out the present invention, in case there are other retention elements 40, these can have this distribution presented for three retention elements 40, so as to avoid binary moments on the tubular sleeve 20.

In the constructions in which the tubular sleeve 20 presents an upper portion 22 mounted in the interior of the tubular lower portion 4*a* of the crankshaft 4, as illustrated, the retention elements 40 may have only the function of affixing the tubular sleeve 20 of the oil pump 10 to the rotor 6, in which case the fixation arrangement of the present invention may have one or only two retention elements 40.

The mounting of each one of the retention elements 40 to the tubular sleeve 20 is carried out so that they are axially and radially rotatively locked in relation to the tubular sleeve 20, the fixation of the tubular sleeve 20 to the rotor 6 being obtained by interference between a locking portion 41 defined by an outer end portion of each retention element 40, in a circumferential extension 6*c* of the lower hole portion 6*b* of the rotor 6. In the construction presenting a plurality of retention elements 40 disposed around the tubular sleeve 20, each retention element 40 has its locking portion 41 seated on a respective circumferential extension 6*c* of the inner wall of the lower hole portion 6*b* of the rotor 6.

According to a way of carrying out the present invention, in which the fixation arrangement presents at least three retention elements 40, each circumferential extension 6*c* of the inner wall of the lower hole portion 6*b* of the rotor 6 is defined in a plane orthogonal to the axis of the tubular sleeve 20 and which is parallel and axially displaced in relation to the plane of the other circumferential extensions 6*c*.

In a way of carrying out the present invention, each retention element 40 comprises an open ring, having a circumferential extension between about 120° and about 270°. However, the constructions of retention element 40 presenting a circumferential extension between 120° and 180° permit mounting, in a single plane transversal to the axis of the tubular sleeve 20, two or three coplanar retention elements 40.

In the illustrated construction, each retention element comprises an open ring having a circumferential extension between about 180° and about 270°.

Each open ring-shaped retention element 40 presents a locking portion 41 defined by the circumferential extension of the outer edge of the open ring presenting an outer diameter slightly superior to the inner diameter of the lower hole portion 6*b* of the rotor 6, and an inner edge 42 with a diameter slightly superior to the outer diameter of the tubular sleeve 20. The locking portion 41 comprises a median portion 40*a*, disposed on a symmetry median plane X, and two side portions 40*b*, which are symmetric in relation to the symmetry median plane X and defined between the median portion 40*a* and a pair of free ends 40*c* of the open ring.

According to the present invention, the tubular sleeve 20 is provided with at least one outer circumferential channel 23, in whose interior is housed and radially axially locked at least one open ring-shaped retention element 40 mounted around the tubular sleeve 20, so that all or only part of the locking portion 41 can deflect in a direction opposite to that of the mounting displacement of the tubular sleeve 20 in the interior of the rotor 6.

The, or each, outer circumferential channel 23 presents a bottom wall 23*a*, around which is seated the inner edge 42 of at least one retention element 40, a lower side wall 23*b* and an upper side wall 23*c*.

Accordingly, in the illustrated construction, in order to allow each retention element 40 to be securely locked in a respective outer circumferential channel 23, the latter is constructed to incorporate, in its lower side wall 23*b*, two lower stops 24*a* in the form of projections and onto which is seated a side portion 40*b* of the respective retention element 40. The upper side wall 23*c* of each outer circumferential channel 23 can be constructed in order to define a seat, against which is seated at least part of the median portions 40*a* and side portion 40*b* of the retention element 40, the locking portion 41 radially projecting outwardly from the outer circumferential channel 23 along a cantilevered radial extension, with a value that is constant or varies along the outer edge of the retention element 40.

Figure 2:
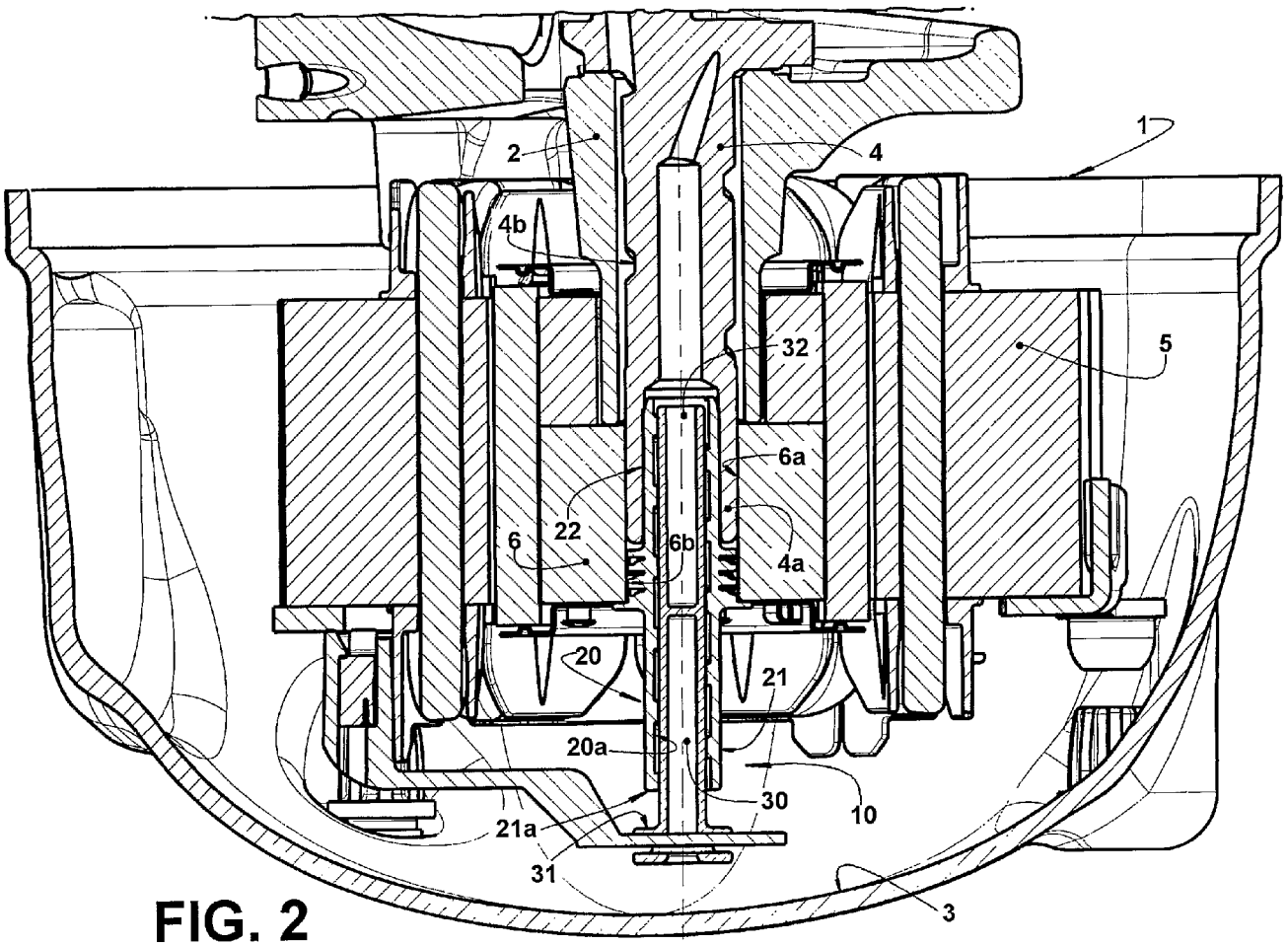
FIG. 2 represents a view similar to that of FIG. 1, but illustrating only the lower region of the crankshaft, in which is mounted an oil pump constructed according to the present invention.
Figure 3:
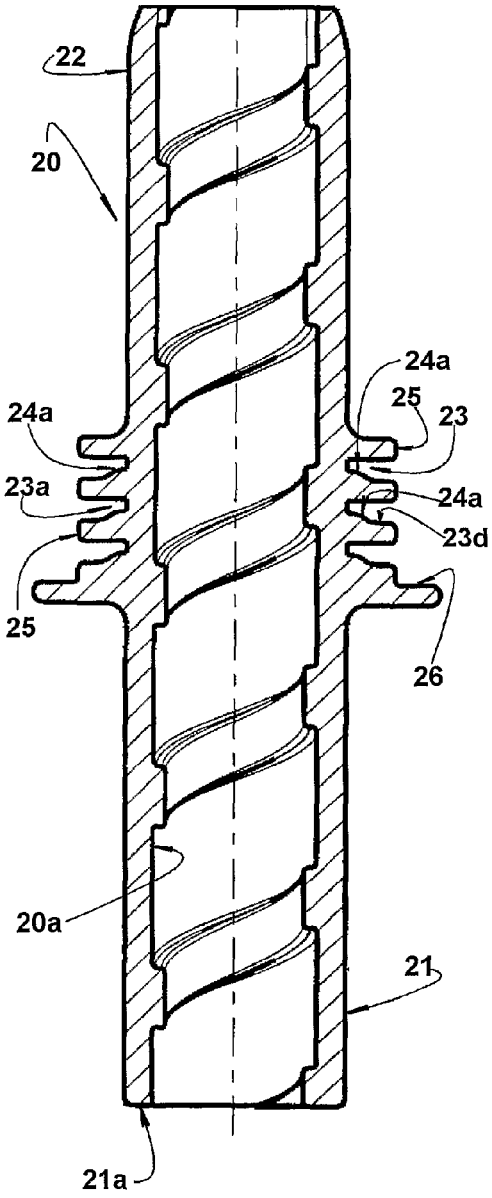
FIG. 3 represents an enlarged longitudinal sectional view of the tubular sleeve of the oil pump of the present invention.
Figure 4:
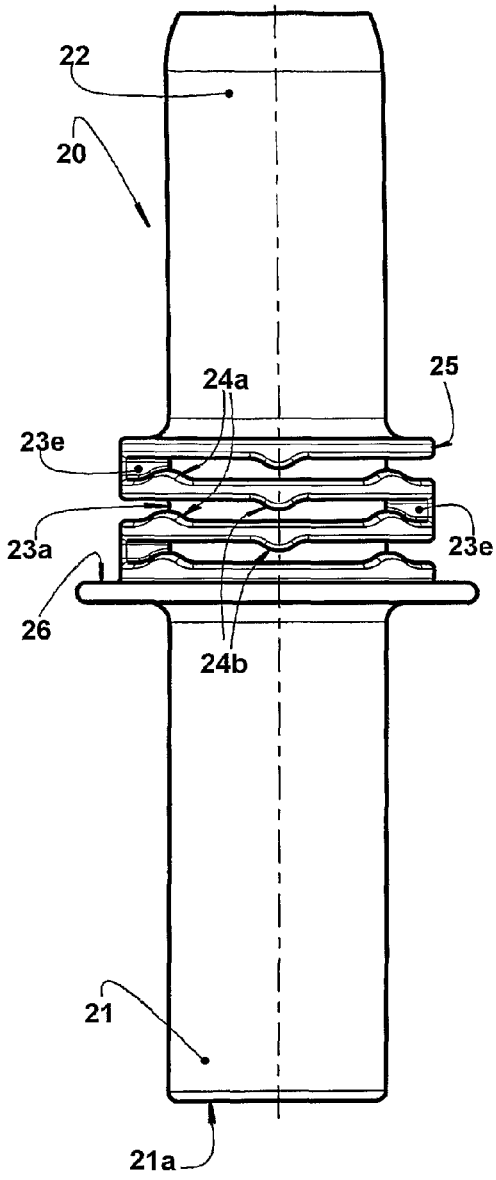
FIG. 4 represents an enlarged side elevation view of the tubular sleeve of the oil pump of the present invention.
Figure 4A:
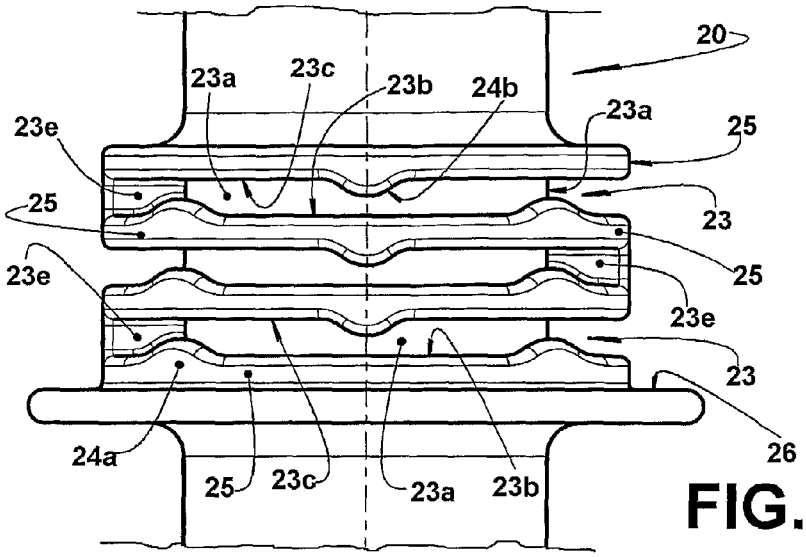
FIG. 4A represents an enlarged view of a median region of the tubular sleeve illustrated in FIG. 4.
Figure 4B:
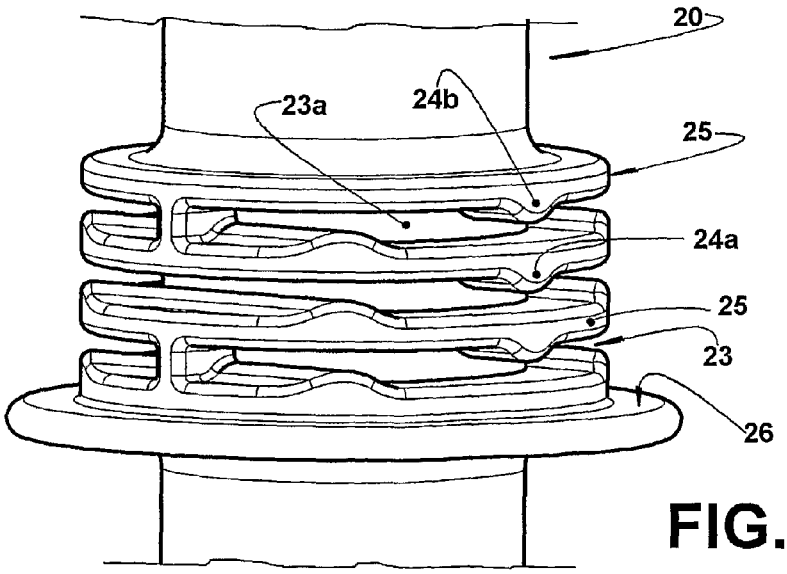
FIG. 4B represents an enlarged perspective view of the median region of the tubular sleeve illustrated in FIG. 4A, but taken in a direction angularly displaced in about 45° leftwards in relation to the view represented in FIGS. 4 and 4A.
Figure 5:
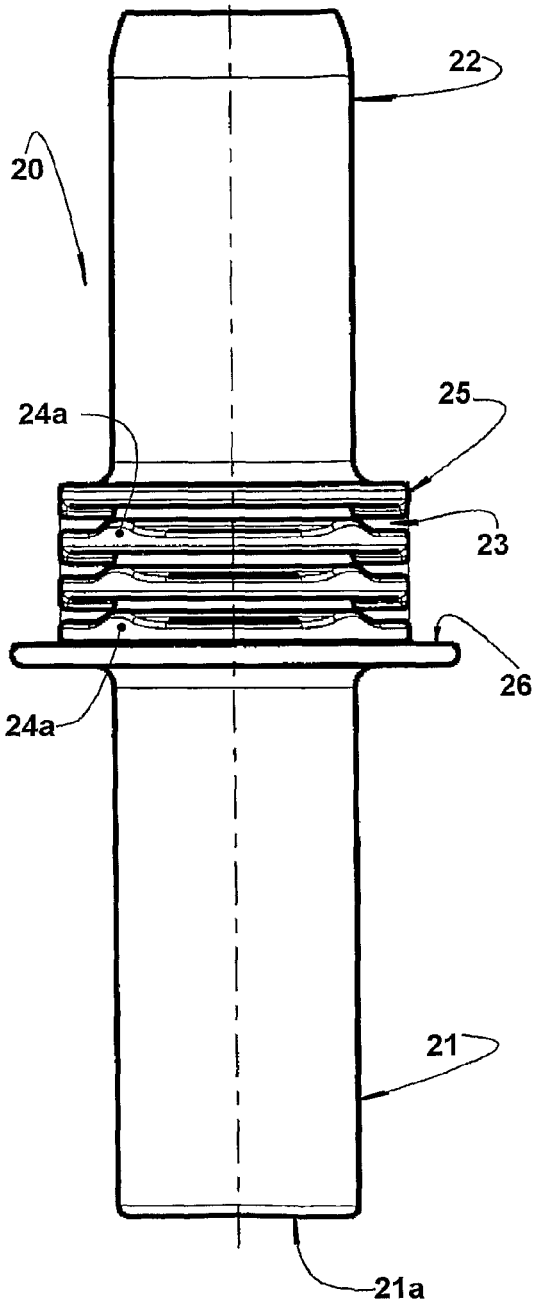
FIG. 5 represents a side elevation view of the tubular sleeve of the oil pump, rotated in 90° in relation to the position illustrated in FIG. 4.
Figure 6:
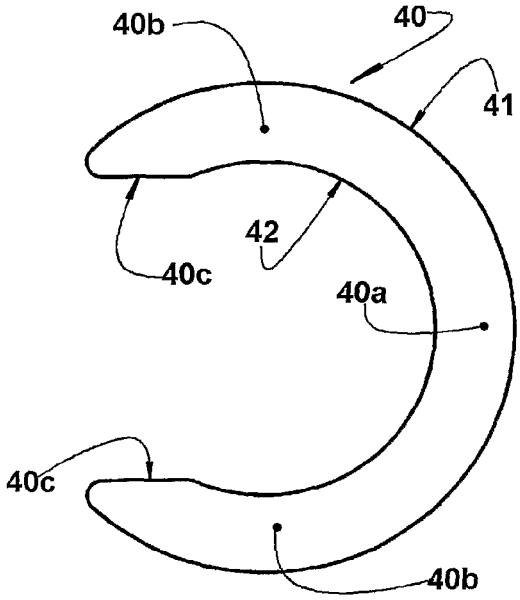
FIG. 6 represents a top plan view of a retention element in the form of an open ring.
Figure 7:
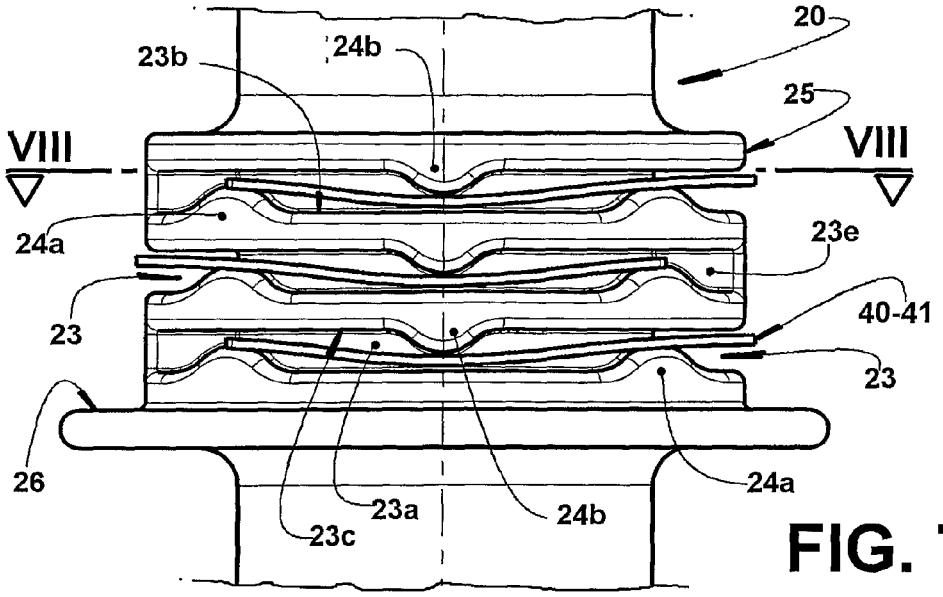
FIG. 7 represents a view similar to that of FIG. 4A, but illustrating three retention elements, in the form of open rings an mounted around the tubular sleeve.
Figure 7A:
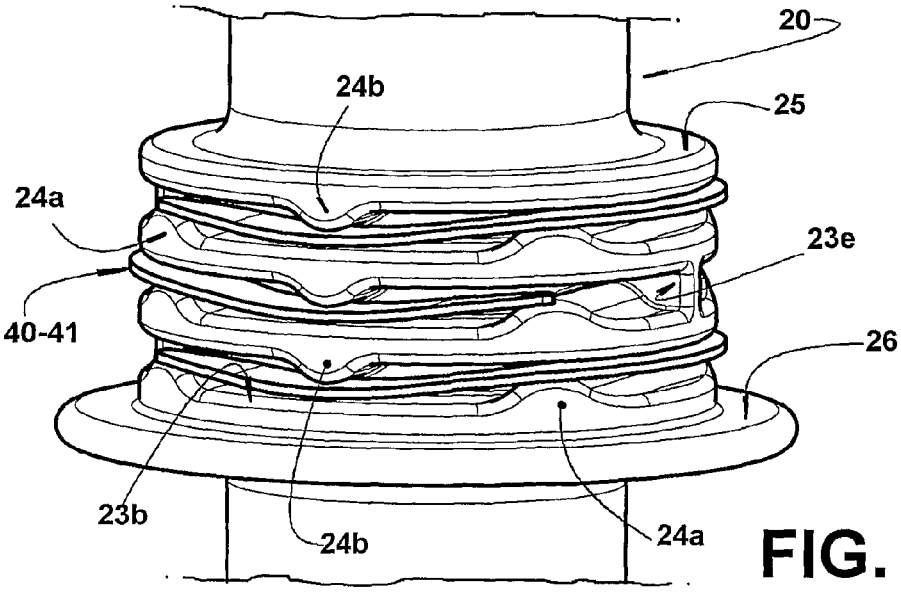
FIG. 7A represents an enlarged perspective view of the median region of tubular sleeve illustrated in FIG. 7, but taken in a direction angularly displaced in about 45° rightwards.
Figure 8:
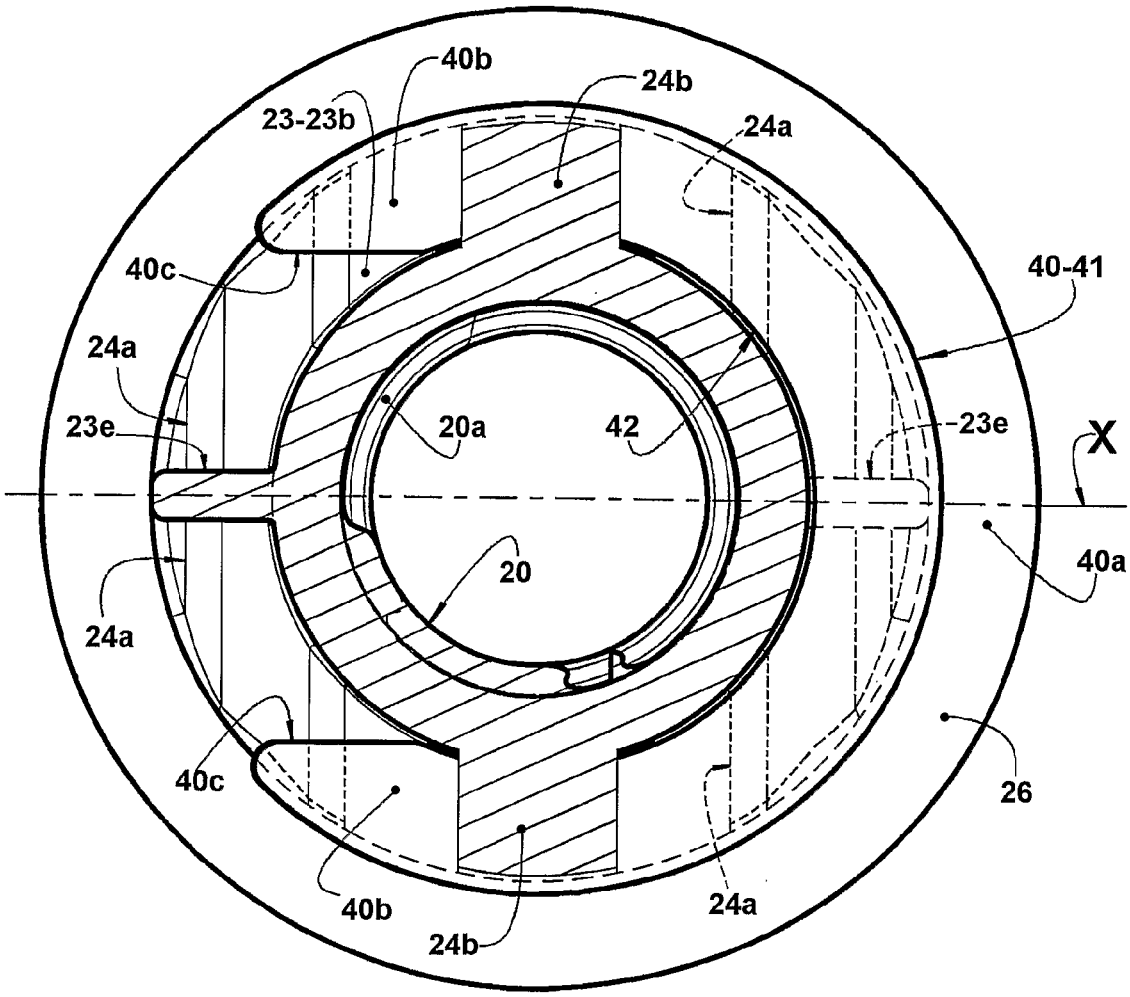
FIG. 8 represents a cross-sectional view of the tubular sleeve already carrying the open ring-shaped retention elements, said view being taken according to the direction of arrows VIII-VIII in FIG. 7 and illustrating only the ring of the outer circumferential channel through which the sectional view is taken.
Figure 9:
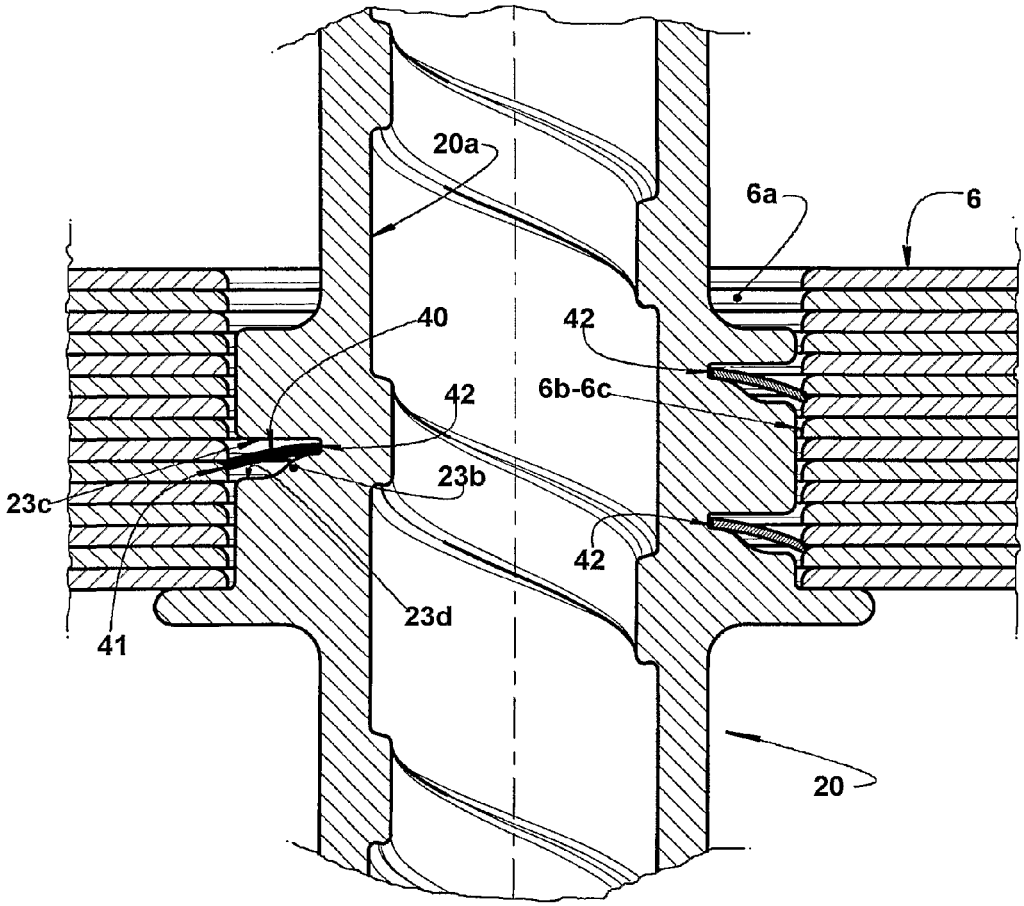
FIG. 9 represents a longitudinal sectional view of the mounting region of the tubular sleeve in the interior of the rotor, illustrating the positioning assumed by the retention elements when interfering with the inner wall of the lower hole portion of the rotor.

Once each retention element 40 is fixedly retained in the respective outer circumferential channel 23, upon the introduction of the tubular sleeve 20 in the interior of the rotor 6, the locking portion 41 of each retention element 40 interferes with a confronting circumferential extension 6*c* of the inner wall of the lower hole portion 6*b* of the rotor 6, being forced and downwardly deflected in the direction opposite to the displacement of the tubular sleeve 20 in relation to the rotor 6 (FIG. 9), the degree of deflection varying along the travel of the locking portion 41 over the inner edge of the lamination stack of the rotor 6, until reaching the final mounting position of the tubular sleeve 20 to the rotor 6, as illustrated in FIG. 2.

In order to allow the locking portion 41 to deflect upon mounting the pump in the rotor 6, each outer circumferential channel 23 has a radially outer extension 23*d*, which is defined in its lower side wall 23*b*, lowered in relation to the plane transversal to the tubular sleeve 20 and according to which the retention element 40 is inferiorly axially seated and retained in the interior of the respective outer circumferential channel 23. In the illustrated constructive example, said seating plane is defined by the plane of actuation of the lower stops 24*a* over the respective portions of the retention element 40 which, in the illustrated embodiment, are defined by the side portions 6*b*.

In the construction illustrated in the enclosed drawings, each outer circumferential channel 23 incorporates, in its lower side wall 23*b*, two lower stops 24*a* that are symmetric in relation to a plane diametral to the tubular sleeve 20. Each lower stop 24*a* is in the form of a projection and the two lower stops 24*a* are operatively associated with two diametrically opposite upper stops 24*b*, also in the form of a projection and which are incorporated in the upper side wall 23*c* of the outer circumferential channel 23, and projecting downwards, between the two lower stops 24*a*, so as to press the retention element 40 and imparting, to the locking portion 41 and to the radial adjacent extensions of the retention element 40 (which are defined, in the illustrated embodiment, in the two side portions 40*b*) radially external to the respective upper stops 24*b*, an initial deflection in the direction opposite to that of penetration of the tubular sleeve 20 in the rotor 6. In this construction, the retention element 40 has one of its side portions 40*b* seated on one of the ends of the two lower stops 24*a* and the other of its side portions 40*b* seated on the opposite ends of said lower stops 24*a*, which extend, in the form of parallel chords, diametrically opposite and orthogonal to the symmetry median plan X.

The pre-deflection of the retention element 40 tends to facilitate the mounting, by interference and with a greater margin of tolerance, of the tubular sleeve 20 in the interior of the rotor 6. It should be understood that, in the illustrated construction, each set of stops, which is formed by each pair of ends of the two lower stops 24*a* and by a respective adjacent upper stop 24*b*, disposed on the same side of a diametral plane of the tubular sleeve 20, actuates against a respective side portion 40*b* of the retention element 40.

According to the drawings, the ends of the lower stops 24*a* and the adjacent upper stop 24*b*, which are disposed on the same side of a diametral plane of the tubular sleeve 20, are symmetrically disposed in relation to the symmetry median plane X of the retention element 40 retained by said stops.

In the construction proposed in the drawings, the two upper stops are symmetrically disposed in relation to the symmetry median plane X of the retention element 40 in the form of an open ring, the two lower stops 24*a* being disposed transversally to said symmetry median plane X. The stop arrangement is maintained unaltered in the different outer circumferential channels 23, permitting each retention element 40 to be mounted in any of two positions diametrically opposite in relation to the tubular sleeve 20 and, consequently, the retention elements 40 mounted in different levels are sequentially offset from each other by 180°, as better illustrated in FIGS. 7, 7A, 8 and 9.

Each outer circumferential channel 23 further incorporates a radial wall 23*e* disposed so as to be coincident with the symmetry median plane X of the retention element 40, upon mounting the latter in the respective outer circumferential channel 23, said radial wall 23*e* operating as an anti-rotation stop for the retention element 40.

In the illustrated constructive form for the fixation arrangement of the present invention, the tubular sleeve comprises a plurality of outer circumferential channels 23, which are axially adjacent to each other, each receiving a respective retention element 40 in the form of an open ring.

In the illustrated construction, each outer circumferential channel 23 has its bottom wall 23*a* defined by a respective outer surface extension of the tubular sleeve 20 and presents a width substantially larger than the thickness of the respective open ring-shaped retention element 40, the upper side wall 23*c* and the lower side wall 23*b* of each outer circumferential channel 23 incorporating the upper stops 24*b* and lower stops 24*a*, as already previously described. Between and against the lower stops 24*a* and upper stops 24*b* of said upper wall 23*c* and lower wall 23*b* of each outer circumferential channel 23 is axially seated, by interference, at least one respective retention element 40.

In the illustrated constructive form, the outer circumferential channels 23 are defined between outer circumferential ribs 25 incorporated, in a single piece, to the tubular sleeve 20, the latter further comprising, inferiorly to the outer circumferential channels 23, a peripheral annular flange 26, to be seated against a lower end annular lamination of the rotor 6, defining a mounting stop, for limiting the axial displacement of the tubular sleeve 20 to the interior of the lower hole portion of the rotor 6, and also for limiting the introduction and relative axial positioning between the tubular sleeve 20 and the tubular lower portion 4*a* of the crankshaft 4.

For mounting the retention elements 40, presenting a circumferential extension superior to 180°, around the tubular sleeve 20, each retention element 40 is submitted to an elastic deformation and forced, during its introduction in a respective outer circumferential channel 23, to an opening position, which is obtained with a radial spacing of the opposite free ends 40*c* of the open ring, until they reach the outer diameter of the tubular sleeve, said opposite free ends 40*c* being then conducted to a seating condition around the outer surface of the tubular sleeve 20, in the interior of the respective outer circumferential channel 23. In this condition, the inner edge 42 of each retention element can be seated against the outer surface of the tubular sleeve 20, or maintain a small radial gap in relation to the latter, so as to better accommodate the retention element 40 upon its interference with the inner wall of the lower hole portion 6*b* of the rotor 6.

However, in case the retention elements 40 present a circumferential extension inferior to 180°, the mounting of the retention elements 40 around the tubular sleeve 20 is made without elastic deformation of the retention element 40, the radial locking of the latter to the tubular sleeve 20 being obtained by interference of the lower stops and upper stops with each respective retention element 40. In this case, the lower stops 24*a* can take the form and the position indicated by the upper stops 24*b* of the illustrated construction, the two upper stops 24*b* being disposed in a diametrically opposite way on the symmetry median plane X.

In a way of carrying out the present invention, the tubular sleeve 20 presents a diameter of about 10.8 mm, the channels present a thickness of about 1.1 mm and the outer circumferential ribs 25 present a diameter of about 15.6 mm, whilst the peripheral annular flange 26 presents a diameter superior to about 16 mm, which is the diameter of the lower hole portion 6*b* of the rotor 6 in the refrigeration compressor of the type described herein. For these dimensions, each open ring defining a retention element 40 presents an inner diameter from about 10.9 mm to 11 mm, an outer diameter of about 16.1 mm and a thickness of about 0.2 mm. The outer diameter of each retention element 40 will promote, upon introduction of the tubular sleeve 20, which carries the retention elements 40, through the central hole of the rotor 6, a fixation by interference of the locking portion 41 of each retention element 40 against the inner wall of the rotor 6.

In a way of carrying out the present invention, as illustrated in the enclosed drawings, the tubular sleeve is affixed to the rotor 6, an upper portion 22 of said tubular sleeve 20 being mounted in the interior of the tubular lower portion 4*a* of the crankshaft 4. Nevertheless, it should be understood that the present invention is also applicable to the constructions in which the mounting of the upper portion 21 of the tubular sleeve 20 in the interior of the lower portion 4*a* of the crankshaft 4 is not provided.

In a particular construction of the present invention, which is illustrated in the enclosed drawings, the peripheral annular flange 26 is continuous and provided around the whole periphery of the tubular sleeve 20. However, it should be understood that said peripheral annular flange 26 can be provided occupying only part of the peripheral extension of the tubular sleeve 20, or also provided in the form of flange segments around part or all of said peripheral extension of the tubular sleeve 20.

In another possible construction, the peripheral annular flange 26 and the circumferential ribs 25 are not incorporated, in a single piece, to the tubular sleeve 20. They can be, for example, retained in said sleeve 20 by any appropriate means, such as thread, fitting, glue, etc. The mounting of the pump shaft 30 in the interior of the tubular sleeve 20 is carried out so that one upper end portion 32 of the pump shaft 30 is maintained with a certain axial spacing in relation to the interior of the lower portion 4*a* of the crankshaft 4, said axial spacing being particularly defined in relation to an adjacent inner wall portion of the crankshaft 4. This axial spacing defines a passage chamber in the interior of the crankshaft 4, to which passage chamber an upper end of each helical groove 20*a* of lubricant oil ascending channel is opened, allowing the fluid communication between the lubricant oil of the oil sump 3 and said passage chamber, which maintains fluid communication with the outer oil channel of the crankshaft 4, conducting lubricant oil to the compressor parts to be lubricated.

Although the concept presented herein has been described considering mainly the oil pump construction as illustrated, it should be understood that this particular construction does not imply any restriction to the applicability of the present invention. What is intended to protect is the principle and not the specific application or constructive form.

The invention claimed is:

1. A fixation arrangement for an oil pump in a refrigeration compressor of the type which comprises: a shell (1) inferiorly defining an oil sump (3) and carrying: a cylinder block (2) in which is journalled a crankshaft (4) having a lower portion (4*a*) projecting downwards from the cylinder block (2); an electric motor rotor (6) formed by a stack of annular laminations defining an axial central hole (6*a*) having an upper hole portion, inside which is fitted and affixed the lower portion (4*a*) of the crankshaft (4), and a lower hole portion (6*b*); an oil pump (10) comprising a tubular sleeve (20), superiorly mounted to the rotor (6) and inferiorly immersed in the oil sump (3), and a stationary pump shaft (30) internal to the tubular sleeve (20) and defining an annular gap with the inner wall of the latter, and having a lower end (31) supported by one of the parts of the shell (1) and cylinder block (2), characterized in that it comprises at least one retention element (40) disposed around the tubular sleeve (20) and which is radially and axially locked thereto, the retention element (40)

having a radially outer locking portion (41), which is seated and radially forced against a respective and confronting circumferential extension (6*c*) defined between two consecutive annular laminations, so as to axially lock the tubular sleeve (20) to the rotor (6).

2. The arrangement, as set forth in claim 1, characterized in that it comprises a plurality of retention elements (40) disposed around the tubular sleeve (20) in at least one plane transversal to the axis of the tubular sleeve (20), each retention element (40) having its locking portion (41) seated on a respective circumferential extension (6*c*) of the inner wall of the lower hole portion (6*b*) of the rotor (6).

3. The arrangement, as set forth in claim 2, characterized in that each retention element (40) comprises an open ring, having a circumferential extension between about 120° and about 270° and presenting an outer diameter slightly superior to the inner diameter of the lower hole portion (6*b*) of the rotor (6).

4. The arrangement, as set forth in claim 3, characterized in that the tubular sleeve (20) carries at least one outer circumferential channel (23), in whose interior is housed and axially locked at least one retention element (40) mounted around the tubular sleeve (20), so that at least part of the locking portion (41) can deflect in a direction opposite to that of the mounting displacement of the tubular sleeve (20) in the interior of the rotor (6).

5. The arrangement, as set forth in claim 4, characterized in that it comprises a plurality of outer circumferential channels (23), axially adjacent to each other, each receiving at least one retention element (40) in the form of an open ring.

6. The arrangement, as set forth in claim 5, characterized in that each retention element (40) in the form of an open ring presents an inner edge (42) to be seated around a bottom wall (23*a*) of a respective outer circumferential channel (23).

7. The arrangement, as set forth in claim 6, characterized in that each outer circumferential channel (23) has its bottom wall (23*a*) defined by a respective outer surface extension of the tubular sleeve (20).

8. The arrangement, as set forth in claim 7, characterized in that each outer circumferential channel (23) has an upper side wall (23*c*) and a lower side wall (23*b*), the latter presenting a radially outer extension (23*d*) lowered in relation to a plane transversal to the tubular sleeve (20) and according to which the retention element (40) is inferiorly and axially seated and retained in the interior of the respective outer circumferential channel (23).

9. The arrangement, as set forth in claim 8, characterized in that each outer circumferential channel (23) presents a width substantially larger than the thickness of the respective retention element (40), the lower side wall (23*b*) and upper side wall (23*c*) of each outer circumferential channel (23) incorporate lower stops (24*a*) and upper stops (24*b*), between and against which is axially seated, by interference, at least one respective retention element (40).

10. The arrangement, as set forth in claim 9, characterized in that each outer circumferential channel (23) incorporates, in its lower side wall (23*b*), two lower stops (24*a*) that are symmetric in relation to a plane diametral to the tubular sleeve (20) and, in its upper side wall (23*c*), two upper stops (24*b*) projecting downwards, between the lower stops (24*a*), in order to press the retention element (40), imparting to the locking portion (41) and to radial adjacent extensions of side portions (40*b*), radially external to the respective upper stops (24*b*), an initial deflection in the direction opposite to the penetration of the tubular sleeve (20) in the rotor (6).

11. The arrangement, as set forth in claim 10, characterized in that each one of the side portions (40*b*) of the retention element (40) is retained between the ends of the lower stops (24*a*) and the adjacent upper stop (24*b*), disposed on the same side of a diametral plane of the tubular sleeve (20).

12. The arrangement, as set forth in claim 11, characterized in that the ends of the lower stops (24*a*) and the adjacent upper stop (24*b*) disposed on the same side of a diametral plane of the tubular sleeve (20) are symmetrically disposed in relation to a symmetry plane (X) of the retention element (40) retained by said stops.

13. The arrangement, as set forth in claim 12, characterized in that the outer circumferential channels (23) are defined between outer circumferential ribs (25) incorporated, in a single piece, to the tubular sleeve (20).

14. The arrangement, as set forth in claim 13, characterized in that the tubular sleeve (20) comprises, inferiorly to the outer circumferential channels (23), a peripheral annular flange (26), to be seated against a lower end annular lamination of the rotor (6), defining a mounting stop for limiting the axial displacement of the tubular sleeve (20) to the interior of the lower hole portion (6*b*) of the rotor (6).

15. The arrangement, as set forth in claim 14, in which the lower portion (4*a*) of the crankshaft (4) is tubular, characterized in that the tubular sleeve (20) presents a first end (21) mounted in the interior of the tubular lower portion (4*a*) of the crankshaft (4).

16. The arrangement, as set forth in claim 2, characterized in that the plurality of retention elements (40) comprises at least two retention elements (40) axially aligned and spaced from each other and at least one retention element (40) diametrically opposite and axially and equally spaced in relation to the first ones.

* * * * *